US007431075B2

(12) United States Patent
Brooks et al.

(10) Patent No.: US 7,431,075 B2
(45) Date of Patent: Oct. 7, 2008

(54) PROPELLANT FRACTURING OF WELLS

(75) Inventors: James E. Brooks, Manvel, TX (US); Philip Kneisl, Pearland, TX (US); Alexander F. Zazovsky, Houston, TX (US); Mark C. Duhon, Sugar Land, TX (US); Alfredo Fayard, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 197 days.

(21) Appl. No.: 11/162,576

(22) Filed: Sep. 15, 2005

(65) Prior Publication Data

US 2006/0070739 A1 Apr. 6, 2006

Related U.S. Application Data

(60) Provisional application No. 60/522,480, filed on Oct. 5, 2004.

(51) Int. Cl.
*E21B 43/263* (2006.01)

(52) U.S. Cl. ..... 166/55; 89/1.15; 102/275.5; 102/275.6

(58) Field of Classification Search ..... 166/297, 166/55; 89/1.15; 102/275.5, 275.6, 313, 102/314, 331, 332
See application file for complete search history.

(56) References Cited

U.S. PATENT DOCUMENTS

| | | | | |
|---|---|---|---|---|
| 2,468,274 | A | 4/1949 | Riley | |
| 2,530,833 | A * | 11/1950 | Martin | 175/4.56 |
| 3,422,760 | A * | 1/1969 | Mohaupt | 102/313 |
| 3,598,052 | A | 8/1971 | Schwartz et al. | |
| 4,039,030 | A | 8/1977 | Godfrey | |
| 4,391,337 | A | 7/1983 | Ford | |
| 4,583,602 | A | 4/1986 | Ayers | |
| 4,673,039 | A | 6/1987 | Mohaupt | |
| 4,823,875 | A | 4/1989 | Hill | |
| 5,131,472 | A | 7/1992 | Dees | |
| 5,271,465 | A | 12/1993 | Schmidt | |
| 5,295,545 | A | 3/1994 | Passamaneck | |
| 5,690,171 | A | 11/1997 | Winch et al. | |
| 5,775,426 | A | 7/1998 | Snider | |
| 6,082,450 | A | 7/2000 | Snider | |
| 6,439,121 | B1 | 8/2002 | Gillingham | |
| 6,494,261 | B1 | 12/2002 | Pahmiyer | |
| 2002/0096040 | A1 | 7/2002 | Barker et al. | |
| 2003/0155112 | A1 * | 8/2003 | Tiernan et al. | 166/63 |
| 2004/0159432 | A1 | 8/2004 | Johnson et al. | |
| 2006/0048664 | A1 * | 3/2006 | Tiernan et al. | 102/332 |

FOREIGN PATENT DOCUMENTS

| | | | |
|---|---|---|---|
| FR | 2506449 | A | 11/1982 |
| GB | 2407111 | A | 4/2005 |

* cited by examiner

*Primary Examiner*—William P Neuder
(74) *Attorney, Agent, or Firm*—Trop, Pruner & Hu, P.C.; Kevin B. McGoff; Bryan P. Galloway

(57) ABSTRACT

A propellant assembly for fracturing a formation around a well includes a propellant and a detonating cord wrapped around the propellant, the detonating cord to ignite the propellant upon detonation of the detonating cord. Alternatively, the propellant can include a substantially central axial bore, with the propellant having a plurality of axial slots extending radially outwardly from the axial bore toward the outer surface of the propellant. A detonating cord is arranged within the axial bore of the propellant.

6 Claims, 6 Drawing Sheets

PROPELLANT FRACTURING OF WELLS

CROSS-REFERENCE TO RELATED APPLICATIONS

This claims the benefit of U.S. Provisional Application Ser. No. 60/522,480, filed Oct. 5, 2004.

BACKGROUND OF THE INVENTION

1. Field of the Invention

The present invention relates generally to fracturing a well formation, and more particularly to propellant assemblies for creating fractures in a well.

2. Background

Techniques for perforating and fracturing a formation surrounding a borehole are known in the art. Generally, some techniques for perforating and fracturing a formation to stimulate production include the steps of: 1) penetrating a production zone with a projectile; and 2) pressurizing the production zone to initiate and propagate a fracture—either by igniting a propellant device or hydraulically.

Godfrey et al., U.S. Pat. No. 4,039,030, describes a method using a propellant to maintain the pressure caused by a high explosive charge over a longer period. The high explosives are used to generate fractures while the role of the propellant is to extend these fractures. In accordance with this technique, the casing must be perforated prior to ignition of the high explosives and propellant as the high explosives are used exclusively to fracture the formation but not to perforate the casing.

Ford et al., U.S. Pat. No. 4,391,337, describes integrated perforation and fracturing device in which a high velocity penetrating jet is instantaneously followed by a high pressure gas propellant. In essence, a tool including propellant gas generating materials and shaped charges is positioned in a desired zone in the borehole. The penetrating shaped charges and propellant material are ignited simultaneously. The high pressure propellant material amplifies and propagates the fractures initiated by the shaped charges.

In Hill, U.S. Pat. No. 4,823,875, the well casing is filled with a compressible hydraulic fracturing fluid comprising a mixture of liquid, compressed gas, and proppant material. The pressure is raised to a level about 1000 psi greater than the pressure of the zone to be fractured by pumping fluid downhole. The gas generating units are simultaneously ignited to generate combustion gasses and perforate the well casing. The perforated zone is fractured by the rapid outflow of an initial charge of sand-free combustion gas at the compression pressure followed by a charge of fracturing fluid laden with proppant material and then a second charge of combustion gas.

Dees et al., U.S. Pat. No. 5,131,472, and Schmidt et al., U.S. Pat. No. 5,271,465, each concern overbalance perforating and stimulation methods, which employ a long gas section of tubing or casing to apply high downhole pressure. Fluid is pumped downhole until the pressure in the tubing reaches a pressure greater than the fracture pressure of the formation. A perforating gun is then fired to perforate the casing. Because the applied pressure is enough to break the formation, fractures propagate into the formation. The gas column forces the fluid into the fractures and propagates them.

Couet et al., U.S. Pat. No. 5,295,545, describes an overbalance technique for propagating a fracture in a formation by driving a liquid column in the wellbore into the formation by activation of a gas generator (e.g., compressed gas or propellant).

Passamaneck, U.S. Pat. No. 5,295,545, discloses a method of fracturing wells using propellants which burn radially inward in a predictable manner—including a computer program for modeling the burn rate of the propellant to determine a suitable quantity and configuration of the propellant for creating multiple fractures in the surrounding formation.

Snider, et al., U.S. Pat. No. 5,775,426, and Snider, et al., U.S. Pat. No. 6,082,450, each describe an apparatus and method for perforating and stimulating a subterranean formation using a propellant secured to the outside of a perforating gun containing shaped charges or a carrier.

SUMMARY

Some embodiments of the present invention concern an assembly for fracturing a wellbore using a propellant. Generally, embodiments of the present invention are directed at generating a predictable radial propellant burn to produce a fast and sustained pressure rise.

Other or alternative features will be apparent from the following description, from the drawings, and from the claims.

BRIEF DESCRIPTION OF THE DRAWINGS

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate. Moreover, in the specification and appended claims, the term "detonating cord" is intended to include a detonating cord, a deflagrating cord, an igniter cord, or any other cord used to initiate the detonation of another explosive having one or more ignition points.

Figure 1:
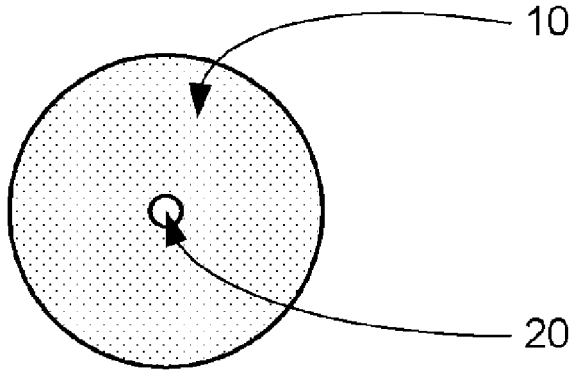
FIG. 1 (PRIOR ART)
FIGS. 1-3 illustrate prior art propellant assemblies.
Figure 2:
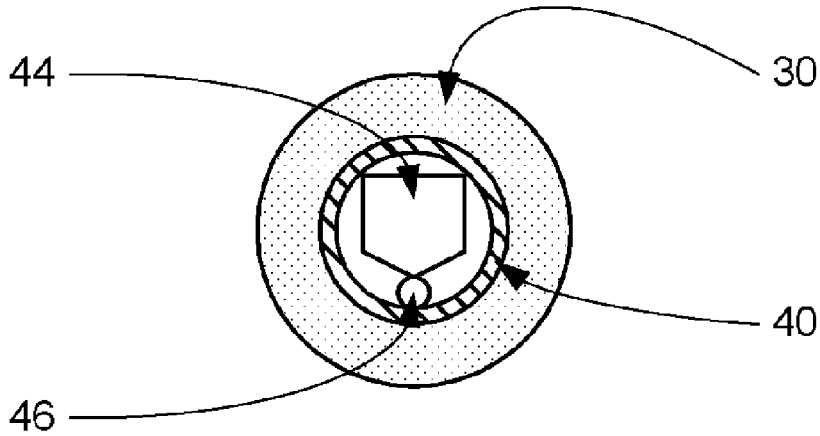
FIG. 2 (PRIOR ART)

Three prior art propellant systems for fracturing a selected the underlying formation of a selected well zone of a subterranean well include: [1] ignition of a solid propellant stick 10 by means of a detonating cord 20 that runs through the center of the propellant (FIG. 1A); [2] a sheath of propellant 30 surrounding a perforating gun 40 containing explosive shaped charges 44 and a detonating cord 46, where the gun fires, producing perforations in the wellbore and a following high pressure pulse from simultaneous ignition of the propellant (FIG. 1B); and [3] ignition of a solid propellant stick 50 by means of a detonating cord 60 that runs along the outer surface of the propellant (FIG. 1C).

With respect to FIGS. 1A and 1B, both the first and second systems purport to produce a dynamic pressurization of the wellbore of a high magnitude taking just a few milliseconds to achieve and lasting for many milliseconds. Research indicates that multiple fractures can be achieved if the rise time is of the order of a few milliseconds. Maximum pressure should be achieved after burning a fraction of the propellant mass (about 20% may be typical). The disadvantage of these systems is that the pressure pulse is unpredictable because of the uncertainty of the propellant burn, with the detonating cord (or shaped charges) causing initial fracturing of the propellant grain, exposing an undetermined surface for the burn. This may result in uncontrolled burning of the propellant that results in high, unpredictable pressure peaks that can unseat plugs, damage casing, or otherwise hinder downhole operations. Moreover, in these designs, the resulting propellant burn and subsequent pressure pulse in the wellbore is highly dependent on what the initiation shock does to the propellant. For example, in the system shown in FIG. 1B, the intent is to use the jet formed by detonation of the shaped charge 44 to start the propellant sheath 30 burning at the point that the jet penetrates the propellant. But, the detonation of the shaped charge 44 may spall off chunks of the propellant 30 that do not burn and may also create fractures that unpredictably increase the burn rate along the propellant's surface. In another example, such as the system shown in FIG. 1A, detonating the propellant stick 10 at its center may fracture the propellant, opening an uncertain number of pathways for the propellant to burn, leading to an unpredictable pressure pulse in the wellbore. In some cases, the burn rate can be so fast as to cause the propellant 10 to detonate.

Figure 4A:
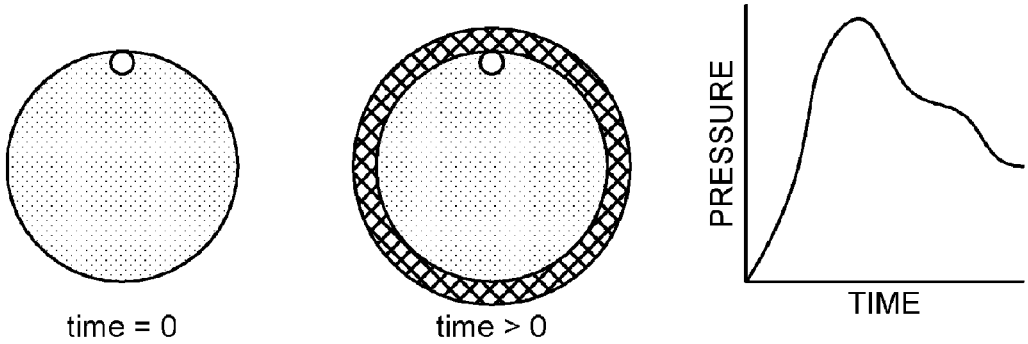
FIG. 4A illustrates designed burn patterns and pressure-time modeling of the prior art propellant assembly illustrated in FIG. 3.
Figure 4B:
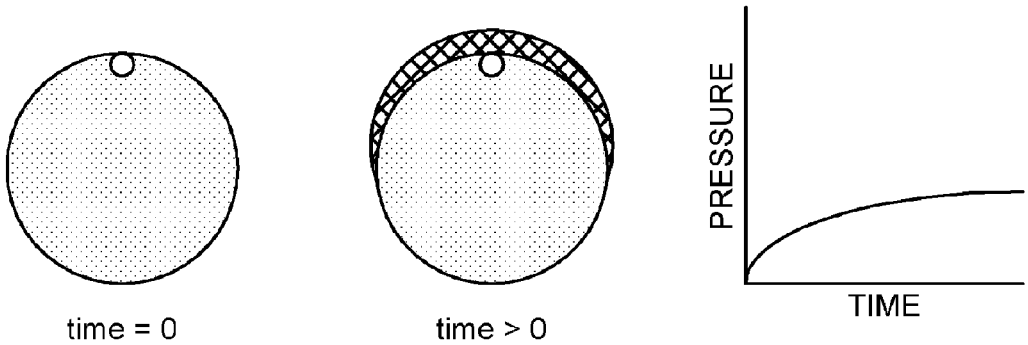
FIG. 4B illustrates actual observed burn patterns and pressure-time modeling of the prior art propellant assembly illustrated in FIG. 3.

With respect to FIG. 1C, the third system purports to be an effort to overcome the uncertainty of the first two systems (e.g., the unpredictability of the burn rate) and to give certainty to the resulting pressure pulse in the wellbore. By starting the propellant burn on the outside surface of the propellant 50 with a weak but sustainable initiation, the propellant may not fracture and the surface burn path may be more predictable, thus allowing for the possibility of allowing a stimulation job to be precisely calculated and properly designed. The third system depends on the initial burn spreading from the initiation line (i.e., the detonating cord 60) almost instantaneously around the circumference of the propellant 50. This quick surface propagation is needed to achieve a radial burn that quickly (within a few milliseconds) pressurizes the wellbore to achieve multiple fractures (FIG. 4A). A mild detonating cord 60 may be used to provide just enough energy to ignite the propellant 50 but not enough to cause fracturing or spalling. However, it has been observed that the initial burn may spread too slowly across the propellant's surface, and is thus not quick enough to achieve a rise time fast enough for multiple fractures (FIG. 4B). For example, the burn may spread sufficiently fast in a confined air space, but not in a pressured liquid where the growth of the gas bubble is restricted by the inertia and pressure of the liquid and the details of the surrounding wellbore. In addition, gravity acts to lift the hot gas away from the surface and there is considerable heat loss to the liquid that prevents achieving efficient dynamic wellbore pressure. There is also a problem with the solubility of the propellant grain, since exposing it to the wellbore may affect its performance. Furthermore, protecting the surface with a sealant may adversely affect the burn. All of these issues affect the initial pressurization of the wellbore such that the pressure rise time may not be fast enough to initiate multiple fractures and the maximum generated pressure will be much less than predicted by a deterministic burn model.

Various embodiments of the present invention offer several unique configurations to overcome the disadvantages of the three systems described above and to offer other advantages as well. Particularly, the embodiments described below may be employed to produce a desired faster rise time and/or a higher pressure maximum that can be calculated by a deterministic burn model. Moreover, the embodiments below may be employed to initiate a uniform burn of the propellant while reducing the risk of detonation. Other advantages offered be the embodiments below will be apparent to one skilled in the art.

Figure 5:
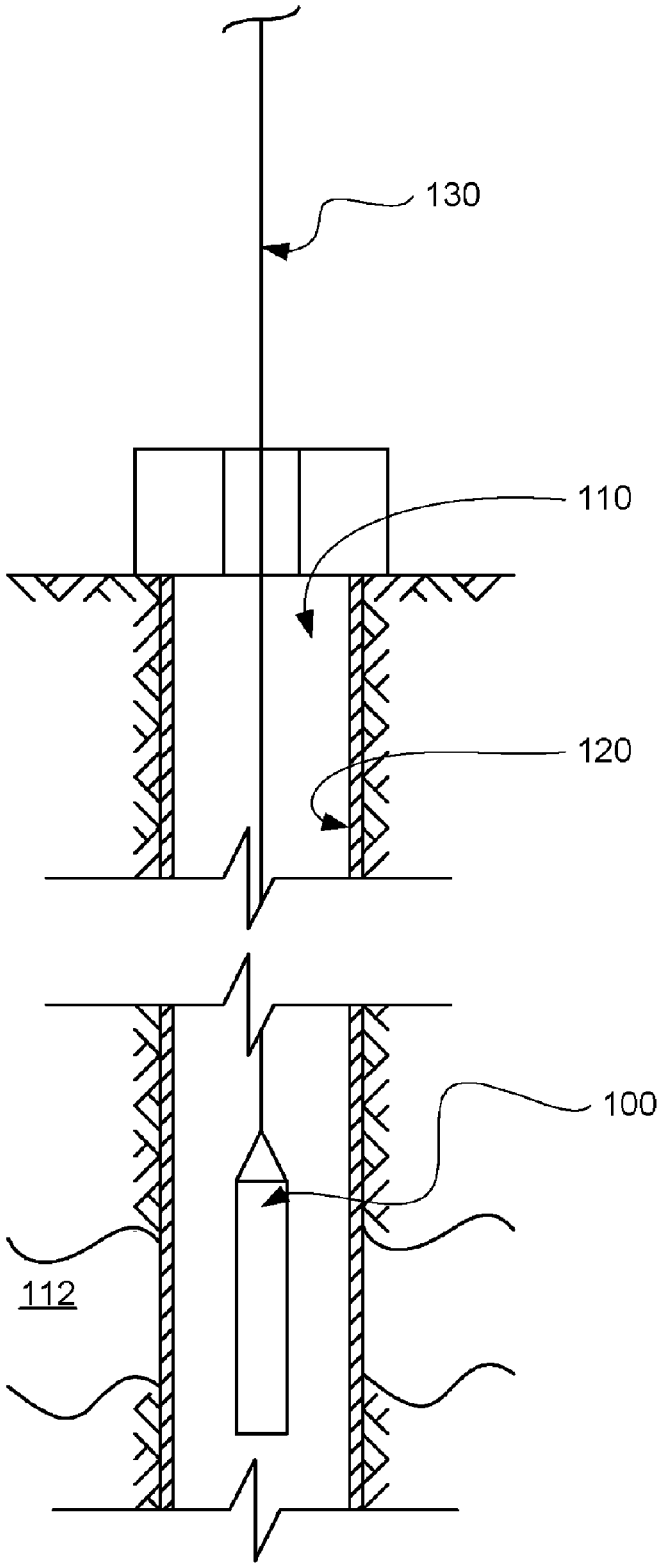
FIG. 5 illustrates a profile view of an embodiment of a propellant assembly of the present being run downhole in a subterranean well.

With respect to FIG. 5, in accordance with embodiments of the present invention, a propellant assembly 100 may be deployed in a well 110 having a target well zone 112 to perform fracturing operations. The well 110 may be supported by a casing 120 or other well tubular (e.g., liner, conduit, piping, and so forth) or otherwise an open or uncased well (not shown). The propellant assembly 100 may be deployed in the well 110 via any communication line 130 including, but not limited to, a wireline, a slick line, or coiled tubing. In operation, the propellant assembly 100 may be deployed in the well 110 to perform an operation at the target well zone 112.

Figure 3:
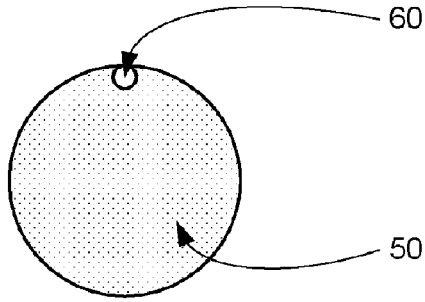
FIG. 3 (PRIOR ART)
Figure 6:
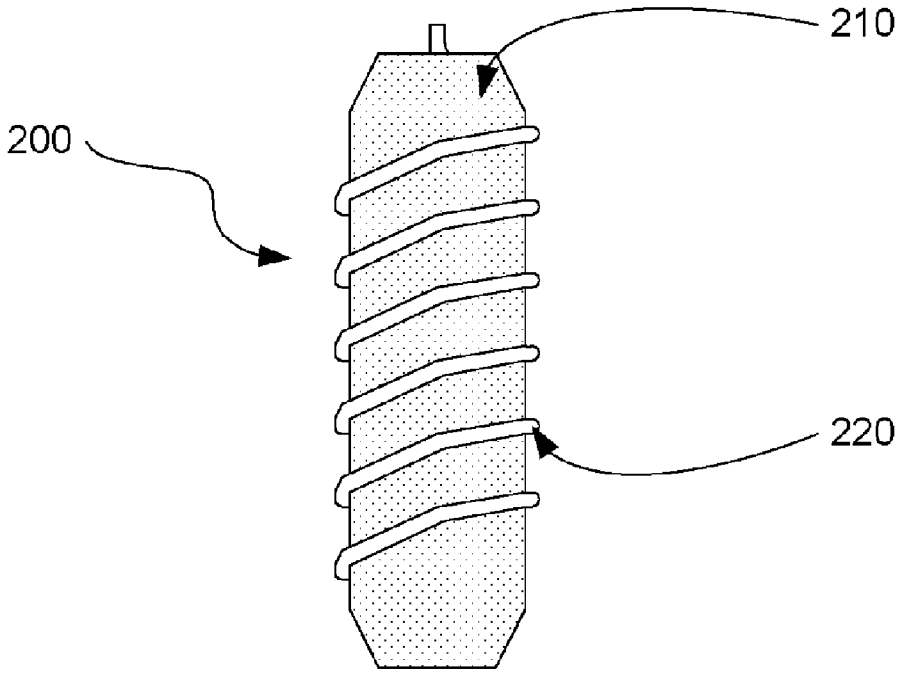
FIG. 6 illustrates a profile view of an embodiment of a propellant assembly having the detonating cord wrapped around the outer surface.

FIG. 6 illustrates one embodiment of a propellant assembly 200 including a propellant 210 with an externally-wrapped detonating cord 220. Some embodiments may use a mild detonating cord (as in the system shown in FIG. 3). In such cases, the detonating cord 220 is wrapped tightly around the propellant 210. This requires a flexible detonating cord 220, which may be wrapped around propellant in any number of configurations (e.g., a helix, a zig-zag, a criss-cross, or a combination thereof, or other patterns). Thus, most of the surface of the propellant 210 is ignited whenever the cord 220 detonates to produce a nearly instantaneous radial burn. This results in a faster surface burn (faster rise time), and approaches more of a true radial burn to yield a more predicable burn history. In other embodiments, the detonating cord 220 may be more loosely wound around the propellant 210 to cover less of the surface of the propellant. In such cases, a stronger detonating cord may be required.

Figure 7:
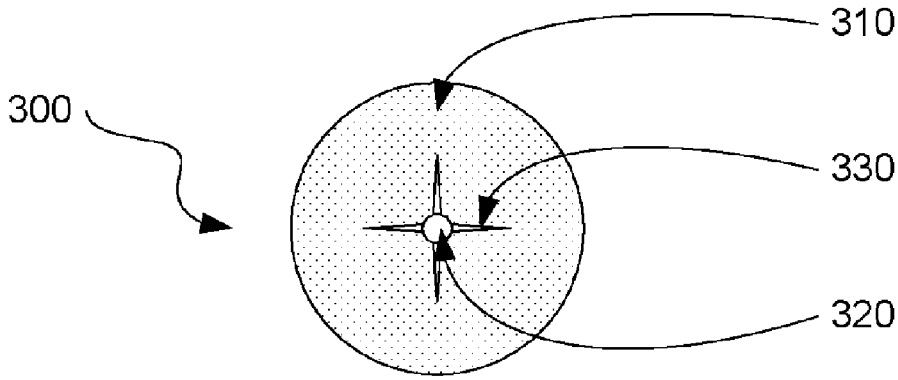
FIG. 7 illustrates a cross-sectional view of an embodiment of a propellant assembly having the detonating cord run therethrough and a set of fracturing slot formed therein extending radially outward.

FIG. 7 illustrates another embodiment of a propellant assembly 300 including a propellant 310 having a detonating cord 320 arranged substantially in the center with one or more slots 330 radiating therefrom. As in the arrangement shown in FIG. 1, the propellant 310 is ignited by the detonating cord 320 that is positioned substantially along the center axis; however, instead of a simple round bore along the central axis, the bore includes pre-formed radial slots 330 that serve as notched initiation sites for fracturing. While four slots arranged in a perpendicular orientation are illustrated in this embodiment, it is intended that other embodiments of the present invention include any number of slots arranged in any number of orientations extending radially outward. In operation, as the cord 320 detonates, the propellant 310 fractures along these radial slots 330 in a determined fashion. The burn gases follow the fractures to ignite the propellant sections along its radius at (in this case) four sectors. This embodiment provides for fracturing and initiation of the propellant 310 in a more predictable manner and thus provides a better opportunity for modeling than the prior art provides.

Figure 8A:
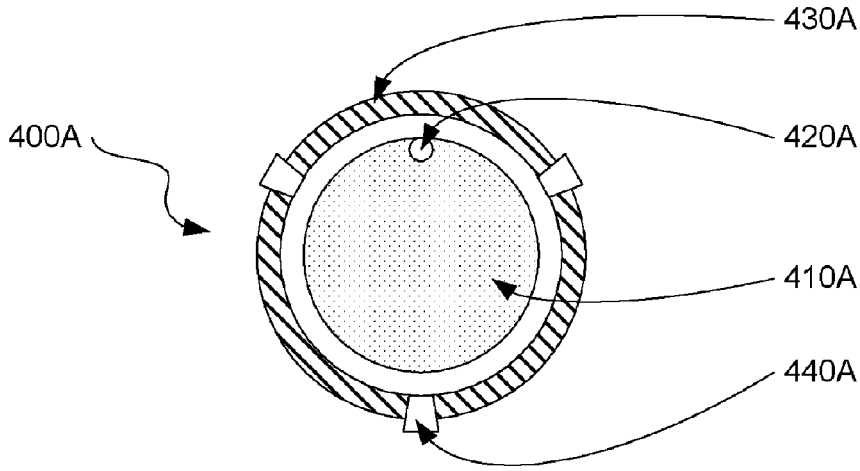
FIGS. 8A-C illustrate profile views of various embodiments of a propellant assembly having a ported housing with temporary port seals and a propellant arranged therein.
Figure 8B:
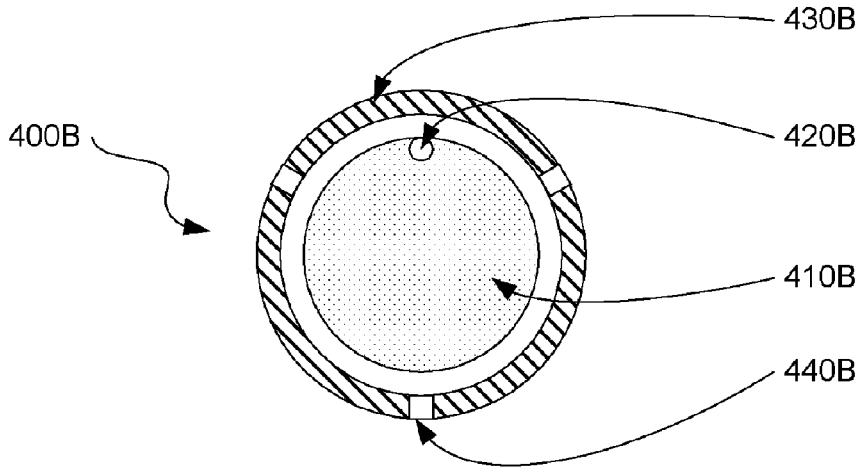
Figure 8C:
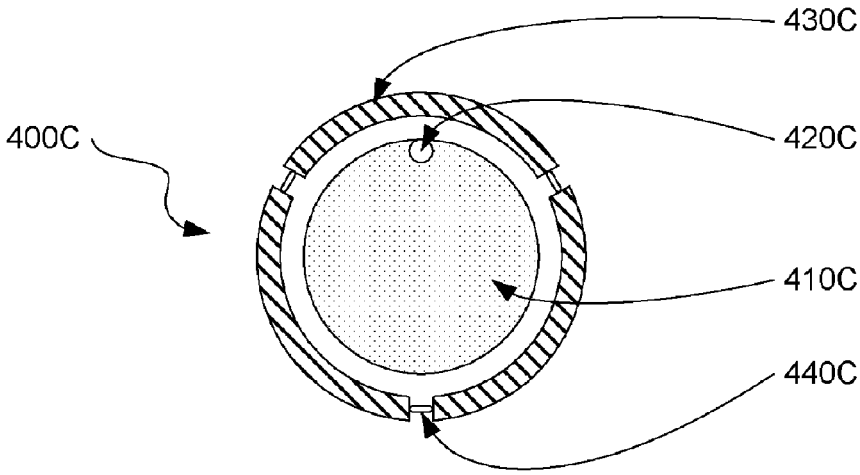
Figure 10:
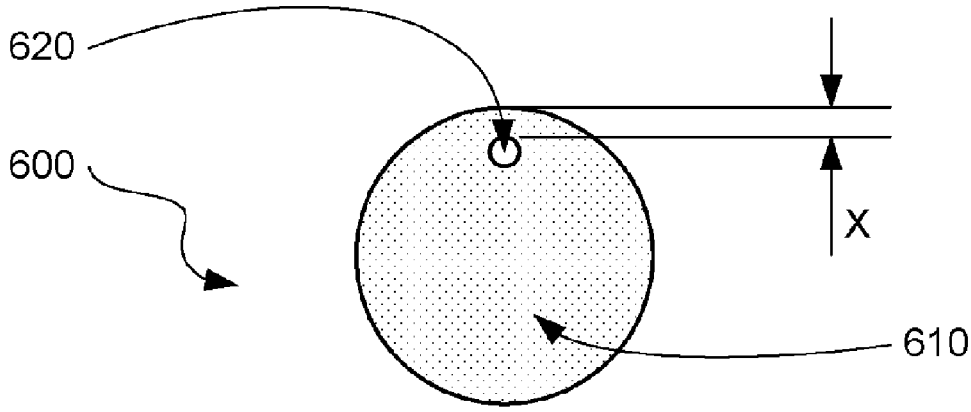
FIG. 10 illustrates a cross-sectional view of an embodiment of a propellant assembly having the detonating cord embedded therein at a selected offset distance.

FIGS. 8A-C illustrate other embodiments of a propellant assemblies 400A, 400B, 400C having a propellant 410A, 410B, 410C and detonating cord 420A, 420B, 420C sealed in a ported housing 430A, 430B, 430C having one or more temporary port seals 440A, 440B, 440C. The housing 430A, 430B, 430C may be fabricated from any structurally sturdy material (e.g., metal or plastic) having one or more ports. In some embodiments, the housing may be reusable and in others it may be fabricated for only one use. In the embodiments illustrated in FIGS. 8A-C, the propellant 410A, 410B, 410C burns around the perimeter within the housing 430A, 430B, 430C. The pressure builds until vented to the wellbore through the one or more temporary port seals 440A, 440B, 440C. The temporary port seals 440A illustrated in FIG. 8A are pop-off plugs that eject or pop out of the housing 430A at a predetermined internal gas pressure generated by ignition of the propellant 410A. The temporary port seals 440B illustrated in FIG. 8B are burn-out plugs fabricated from a heat or flame responsive material (e.g., aluminum, magnesium, plastic, plastic composite, ceramic, or a combination of a forementioned material with a coating or bonded layer of energetic material such as plastic-bonded HMX, RDX, HNS, TATB, or others, a thermite compound, or other propellant or pyrotechnic material) that burns away during ignition of the propellant 410B or will otherwise rapidly heat and consume or cause to fail the plug. The temporary port seals 440C illustrated in FIG. 8C are rupture discs that rupture at a predetermined internal gas pressure generated by ignition of the propellant 410C. The temporary port seals 440A, 440B, 440C may be fabricated to release at particular wellbore pressure. In alternative embodiments, the propellant assembly may employ a combination of two or more temporary port seals illustrated in FIGS. 8A-C. While the embodiments illustrate in FIGS. 8A-C show the detonating cord 420A, 420B, 420C arranged along the perimeter of the propellant 410A, 410B, 410C and slightly embedded, in other embodiments the detonating cord may be wrapped around the outer surface of the propellant (for example as shown in FIG. 6), embedded completely within the propellant (for example as shown in FIGS. 7 and 10), or otherwise merely run along the outer surface of the propellant. In operation, the propellant 410A, 410B, 410C is ignited by detonation of the detonating cord 420A, 420B, 420C, and as the propellant burns, gas pressure increases within the axial bore of the housing 430A, 430B, 430C. Once the gas pressure reaches a predetermined level, the temporary port seals 440A, 440B, 440C actuate to establish communication between the axial bore of the housing 430A, 430B, 430C and the wellbore. In this way, a higher more predictable gas vent pressure is achieved to facilitate fracturing the target well zone.

Furthermore, embodiments of the port seals prevent well fluids from cooling the propellant ignition or burn. Because propellant burn rates are heat transfer controlled, to achieve increased burn rates, the propellant may be protected from cooling wellbore fluids for as long as necessary to achieve a relatively fast flame spread.

Figure 9:
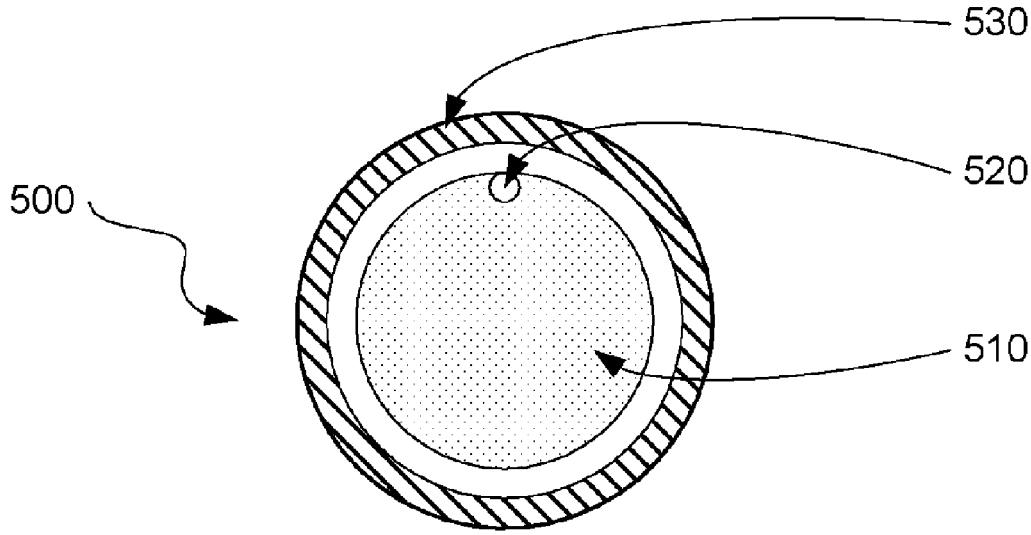
FIG. 9 illustrates a profile view of an embodiment of a propellant assembly having a sealed housing fabricated from a heat or flame responsive material and having a propellant arranged therein.

FIG. 9 illustrates an embodiment similar to those illustrated in FIGS. 8A-C. The propellant assembly 500 shown in FIG. 9 includes a propellant 510 and a detonating cord 520 arranged within a sealed housing 530. The housing 530 is fabricated from a selected material, which is burned away by the propellant 510 during ignition. For example, one embodiment may include a sealed housing fabricated from a thin aluminum material. Other embodiments may include a housing fabricated from an aluminum alloy (e.g., aluminum and magnesium) or plastic. The wall of the housing 530 is sufficiently thick to prevent collapse from hydrostatic pressure in the well, but is thin enough to succumb to the burning propellant 510. As an alternative, the housing wall may be made thinner by having the propellant provide partial support by extruding support structures bridging the space between the inner wall of the housing and the propellant. In operation of these embodiments, the burn of the propellant 510 is contained thus yielding a radial burn by which the housing 530 is consumed. This generates a predictable radial burn, producing a fast and sustained pressure rise. Moreover, before ignition, the propellant 510 is protected from the wellbore fluids by the housing 530. Also, the initial burn is not in contact with the well, thus allowing for sufficient gas development before liquids in the well begin to interact with the hot gas bubble. Furthermore, the housing 530 may be consumed during burning, thus reducing debris while adding energy and duration to the propellant output.

While the embodiments illustrated in FIGS. 8 and 9 depict a solid propellant arranged within a housing, it is intended that other embodiments may include granular propellant pellets. The propellant pellets may include the same formulation as the solid propellant, yet the increased exposed surface area of the pellets may yield an even faster burn with a reduced risk of detonation.

FIG. 10 illustrates another embodiment of a propellant assembly 600 including a propellant 610 and a slightly embedded detonating cord 620. In this embodiment, the detonating cord 620 is embedded just below the surface of the propellant 610 at an offset of X. The offset X may range from just greater than 0 to approximately 75% of the radius of the propellant 610. By slightly embedding the initiation, the initial burn is confined, thus reducing initial heat loss to the surrounding well. This yields a better initiation with less initial heat transfer loss. Moreover, there is less risk of detonation because gas pressure is relieved from the side of the propellant 610 shortly after initiation. Moreover, by initiating from an off-center origin, fewer propellant fragments are concentrated thus limiting uncontrolled pressure increases since the detonation cord position may be optimized to control fragmentation and/or propellant surface area generation. In alternative embodiments, the detonating cord 620 may be positioned at an optimal location along the radial axis to optimize fracturing results depending on the application and well environment.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A propellant assembly for fracturing a formation around a well, the assembly comprising:

a propellant having an outer surface and a substantially central axial bore therethrough, the propellant having a plurality of radial slots extending radially outward from the axial bore toward the outer surface of the propellant, but not intersecting the outer surface of the propellant; and a detonating cord arranged within the axial bore of the propellant.

2. The propellant assembly of claim 1, wherein upon detonation of the detonating cord, the axial slots fracture radially outward to intersect the outer surface of the propellant.

3. The propellant of claim 1, wherein the propellant is a solid stick propellant.

4. The propellant assembly of claim 1, wherein the propellant is granular propellant pellets.

5. A propellant assembly for fracturing a formation around a well, the assembly comprising:

a housing having a chamber therein;

a propellant arranged within the chamber of the housing, the propellant having an outer surface;

a detonating cord arranged within the housing in contact with the propellant; and means for establishing communication between the chamber and the well, wherein the detonating cord is embedded within the propellant, wherein the propellant includes an outer surface and a substantially central axial bore therethrough for receiving the detonating cord, the propellant having a plurality of radial slots extending radially outward from the axial bore toward the outer surface of the propellant.

6. The propellant assembly of claim 1, wherein the detonating cord is adapted to ignite the propellant upon detonation of the detonating cord.

* * * * *